US007234690B2

(12) United States Patent
Campbell et al.

(10) Patent No.: US 7,234,690 B2
(45) Date of Patent: Jun. 26, 2007

(54) HUMIDIFIER WITH SAFETY RESERVOIR

(75) Inventors: Glennbruce S. Campbell, Memphis, TN (US); Larry S. Bias, Flint, TX (US)

(73) Assignee: Hunter Fan Company, Memphis, TN (US)

( * ) Notice: Subject to any disclaimer, the term of this patent is extended or adjusted under 35 U.S.C. 154(b) by 151 days.

(21) Appl. No.: 11/049,476

(22) Filed: Feb. 2, 2005

(65) Prior Publication Data

US 2005/0200031 A1 Sep. 15, 2005

Related U.S. Application Data

(60) Provisional application No. 60/543,102, filed on Feb. 9, 2004.

(51) Int. Cl.
*B01F 3/04* (2006.01)

(52) U.S. Cl. ..... 261/30; 261/72.1; 261/73; 261/119.1

(58) Field of Classification Search ..... 261/30, 261/66, 72.1, 73, 99, 107, 119.1, DIG. 41
See application file for complete search history.

(56) References Cited

U.S. PATENT DOCUMENTS 5,162,088 A * 11/1992 Peng et al. ..... 261/27
5,546,926 A * 8/1996 Lake ..... 126/113
5,752,498 A * 5/1998 Lake et al. ..... 126/113
5,783,117 A 7/1998 Byassee et al. ..... 261/29
6,176,473 B1 * 1/2001 Stanek et al. ..... 261/26
6,769,671 B2 * 8/2004 Rhea et al. ..... 261/72.1
2005/0067723 A1 * 3/2005 Parker et al. ..... 261/26

* cited by examiner

*Primary Examiner*—Scott Bushey
(74) *Attorney, Agent, or Firm*—Baker Donelson

(57) ABSTRACT

A humidifier (10) is disclosed having a top portion (11), a middle portion (12) and a bottom portion (13). The middle portion is essentially a water tank which provides water to be used in humidification. The bottom portion has a floor (41) and side walls (42) extending from the floor to form a tub (43) having a select height (SH1). The bottom portion is configured so that should water be uncontrollably released from the middle portion, the water level within the middle portion (MPEWL) will reach an equilibrium level with the catastrophic water lever (CEWL) within the bottom portion below the selected height of the bottom portion (SH1). When the middle portion water lever (MPEWL) reaches the same height or equilibrium lever with the bottom portion catastrophic water lever (CEWL) the flow of water from the middle portion will cease. As this equilibrium level is below the select height of the bottom portion (SH1) the water will be fully captured and will not overflow onto the underlying floor.

7 Claims, 3 Drawing Sheets

HUMIDIFIER WITH SAFETY RESERVOIR

REFERENCE TO RELATED APPLICATION

This is a continuation-in-part of U.S. patent application Ser. No. 60/543,102 filed Feb. 9, 2004.

TECHNICAL FIELD

This invention relates to humidifiers and specifically to humidifiers with safety reservoirs.

BACKGROUND OF THE INVENTION

Portable humidifiers have existed for many years. These humidifiers typically humidify the air by introducing water vapor into an airstream. The humidifier includes a water tank, a wick and a blower for creating the airstream. Water is passed from the water storage tank through a water release valve into a shallow pan in which the bottom of the wick is positioned so as to distribute the water throughout the wick through capillary action.

With small portable humidifiers that water tank includes a water inlet/outlet that is sealed with a removable cap that includes the water release valve. As such, water is poured into the tank through the inlet and the subsequently sealed in an air tight manner with the removable cap. The tank is then inverted and positioned within the humidifier body to allow the water to escape the tank through action of the release valve. The water reaches a shallow depth in the pan through the action of the valve and the creation of a vacuum in the water storage tank. While this construction works adequately with small tanks it is impractical with large console or floor standing humidifiers.

Console or floor mounted humidifiers are typically designed with substantial water capacity in order to discharge sufficient quantities of humidified air over a predetermined time period. As a result, console or floor mounted humidifiers are generally not removable from a predetermined location in a particular room setting, although such humidifiers are mounted on casters for moving the entire humidifier to a water source for filling, if desired. Other than the cumbersome task of moving the entire humidifier, the typical methods used in refilling such humidifiers is to carry water in buckets or containers which are deposited in a humidifier water compartment or the use of refillable water containers which are detachably mounted to the humidifiers for refilling purposes.

With such large tanks it would be desirous to have a water inlet within the top of the tank while still having a water outlet within the bottom of the tank. To have such, the tank must be provided with an air tight cap so that the water within the tank is not allowed to freely flow from the tank into the shallow pan. If such were to occur that shallow pan will overfill and water will spill onto the underlying floor. Even with such air tight caps such spillages can occur, such as when the cap is not placed back on the tank before the tank is set back into the humidifier body or when such cap is not fully closed to prevent air from flowing into the tank.

It thus is seen that a need remains for a humidifier which will prevent the accidental spillage of water from the water tank. Accordingly, it is to the provision of such that the present invention is primarily directed.

SUMMARY OF THE PRESENT INVENTION

In a preferred form of the invention, a humidifier is provided which comprises a housing defining an air channel and a water reservoir, a water tank, and a motorized fan. The water reservoir has a select water level height to contain a select maximum water volume. The water tank is configured to contain a select maximum volume of water. The water tank is positioned at least partially within the housing reservoir and is adapted to supply water to the water reservoir. The motorized fan is positioned to create an airflow through the air channel. The water reservoir and the water tank have a maximum equilibrium water level therebetween. The maximum equilibrium water level is below the water reservoir select water level height. With this construction, should the water within the water tank overflow into the water reservoir the overflowing water is fully contained within the water reservoir when an equilibrium state is reached between the water reservoir and the water tank.

DETAILED DESCRIPTION OF THE PREFERRED EMBODIMENTS

Figure 1:
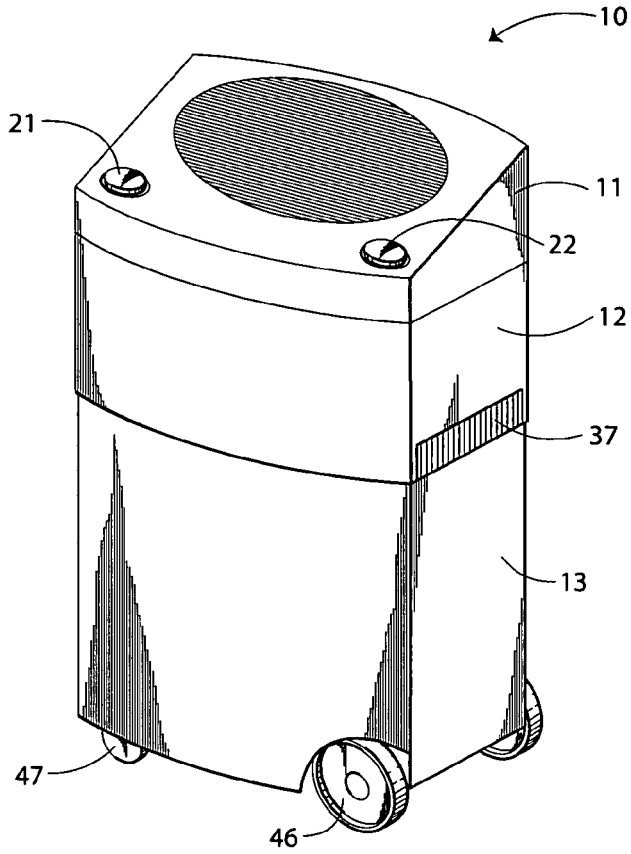
FIG. 1 is a perspective view of a humidifier embodying principles of the invention in a preferred form.
Figure 4:
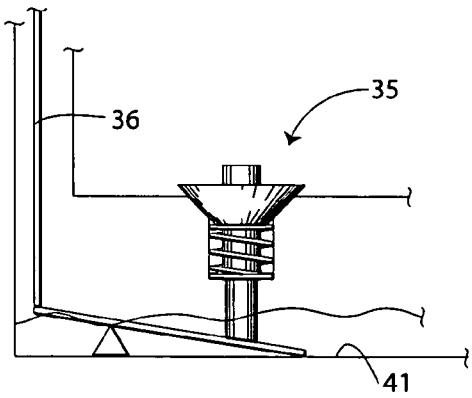
FIG. 4 is a schematic view of the water release valve of the humidifier of FIG. 1, shown in a closed position.
Figure 5:
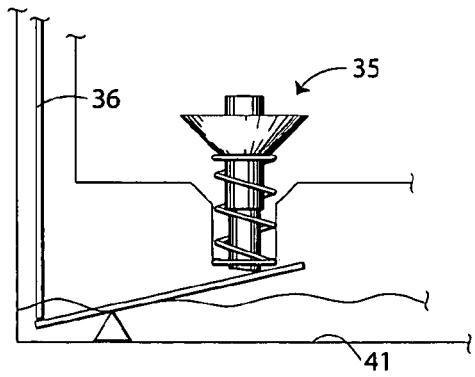
FIG. 5 is a schematic view of the water release valve of the humidifier of FIG. 1, 15 shown in an open position.
Figure 2:
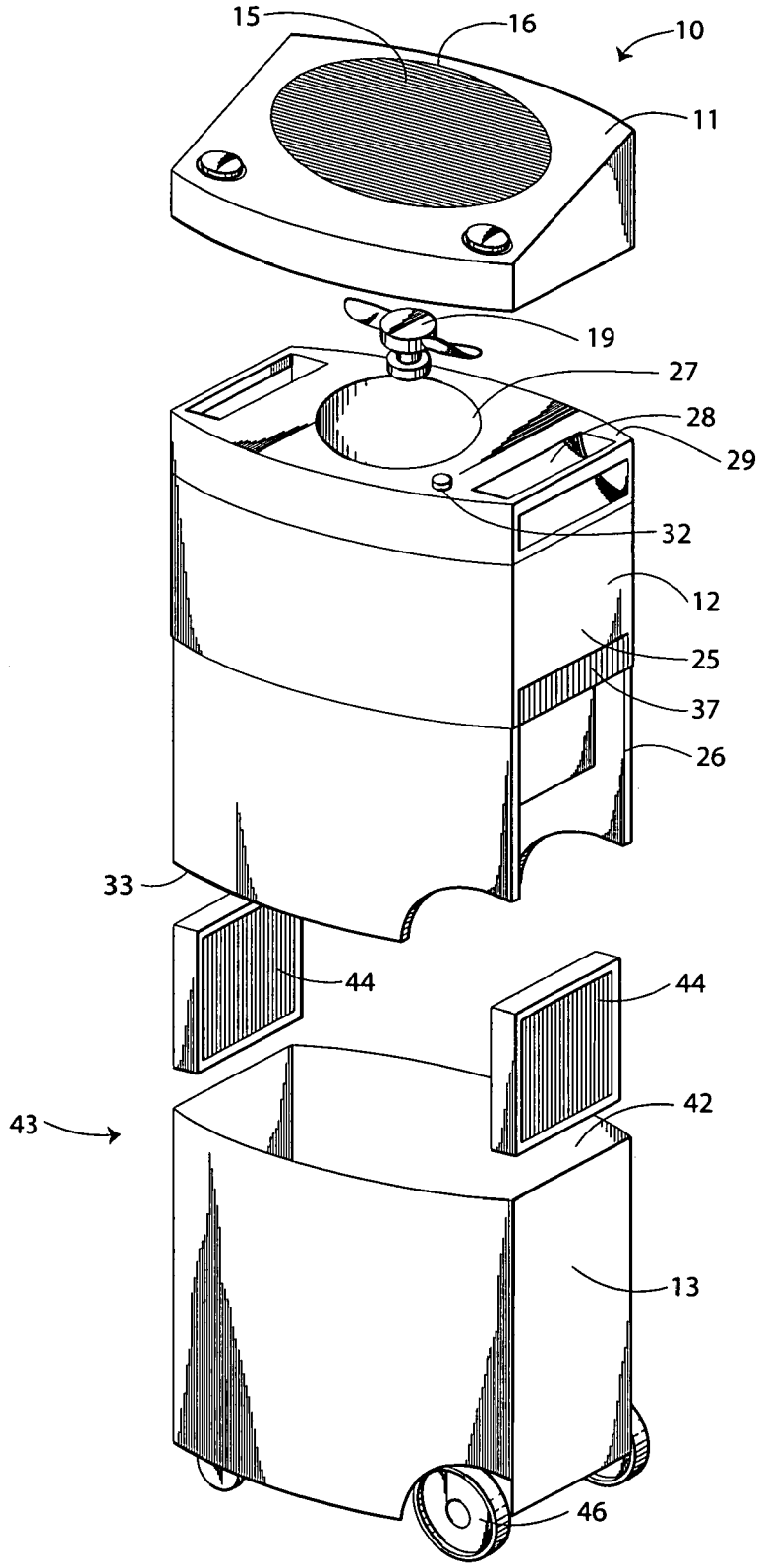
FIG. 2 is an exploded view of the humidifier of FIG. 1.
Figure 3:
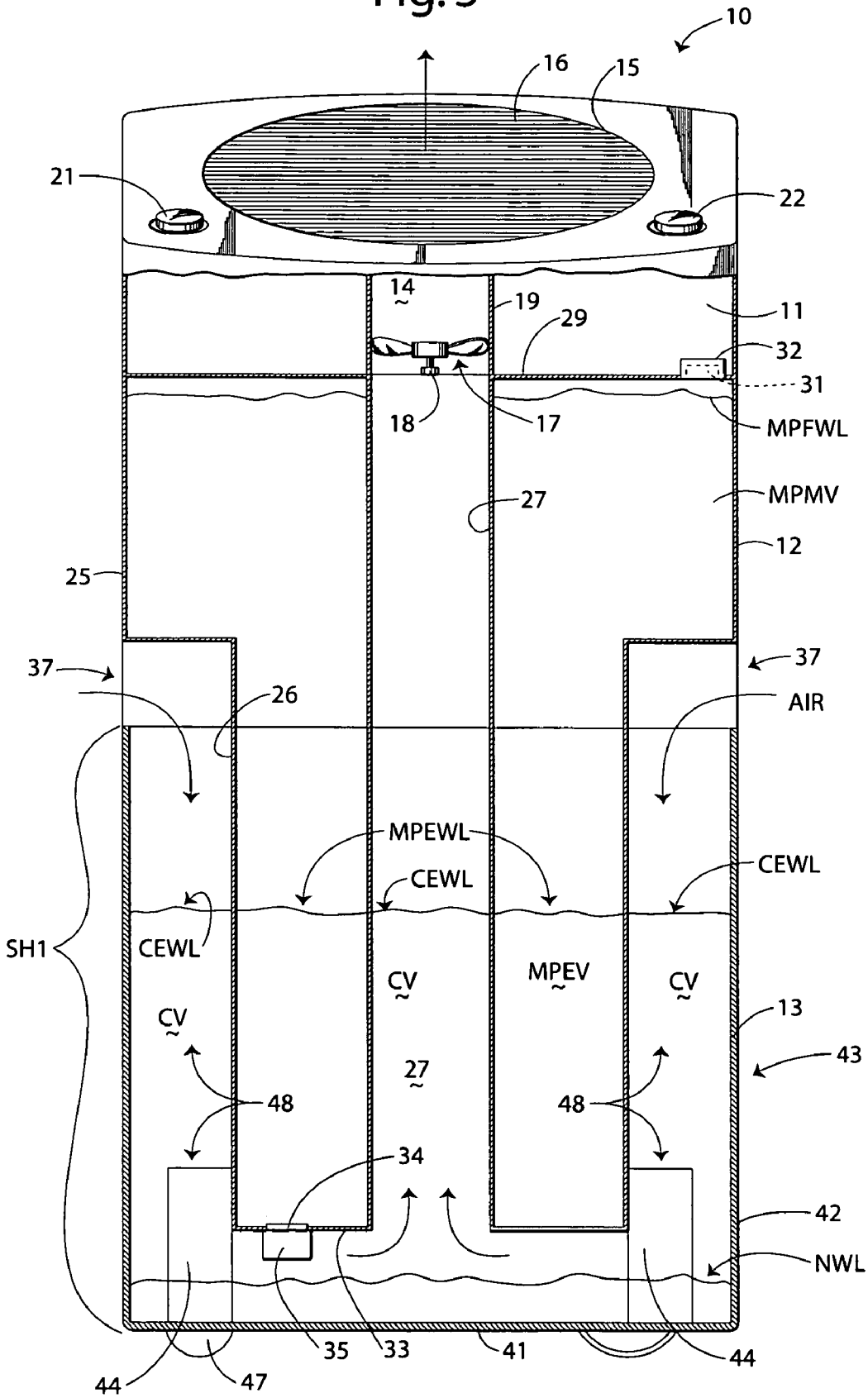
FIG. 3 is a front view shown in partial cross-section of the humidifier of FIG. 1.

With reference next to the drawings, there is shown a humidifier 10 in a preferred form of the invention. The humidifier 10 has a top portion 11, a middle portion 12 and a bottom portion 13. The top portion 11 includes a central air passage 14, a top opening 15 having a safety grate 16 therein, and a motorized blower assembly 17 for directing an airstream through the top opening 15. The blower assembly 17 includes an electric motor 18, an impeller 19 coupled to the electric motor 18, and electrical controls 21 which control the operation and speed of the motor 18 through an on/off switch and fan speed control switch 22.

The middle portion 12 is essentially a water tank having an enlarged upper section 25 extending to a narrowed lower section 26. The middle portion 12 is configured to hold a select maximum volume of water MPMV at a middle portion full water line MPFWL. The upper and lower sections 25 and 26 have a continuous central air passage 27 therethrough which is aligned with the air passage 14 and impeller 19 of the top portion 11. The middle portion 12 has two oppositely disposed handles 28 and a top surface 29 having a water inlet opening 31. A sealable cap 32 is configured to be mounted in an airtight manner to the water inlet opening 31. The middle portion 12 also has a bottom surface 33 having a water outlet 34 with a water release valve 35 therein. The water release valve 35 may be coupled to a handle 36 which is accessible to an operator. The handles 36 may also be configured to automatically actuate the valve to a closing position if a release latch is moved to release the upper or middle portions. The upper section 25 is formed to partially define two oppositely disposed air inlet ports 37.

The bottom portion 13 has a floor 41 and side walls 42 extending from the floor 41 to form a water reservoir or tub 43 having a select height SH1. The bottom portion 13 includes a pair of evaporative wicks 44, a pair of unshown latches, a pair of wheels 46 and a pair of castors 47. The dimensions of the tub 43 are such that the upper section 25 of the middle portion 12 abuts and seats upon the top edge of the tub 43 while the lower section 26 resides within the interior space of the tub. The evaporative wicks 44 are positioned adjacent the floor 41 and within the air inlet channel 48, so that a small amount of water within the tub saturates the wicks 44 through capillary action while still providing enough spacing in the air inlet channel 48 to allow air to pass over the top surface of the water and into the central air passage 27. With the middle portion 12 mounted to the bottom portion 13, the combined volume of the spaces occupied by the air inlet channel 48 and central air passage 27 within the confines of the tub is preferable greater than the 50% of the water volume MPMV of the middle portion 12. This water volume of the bottom portion 13 which is not occupied or otherwise displaced by the middle portion is referred herein as the catastrophic fluid volume CV of the bottom portion.

In use, the top portion 11 is removed from the middle portion 12 and the middle portion 12 is removed from the bottom portion 13 or optionally maintained in a position within the bottom portion and wheeled to a water access location. The cap 32 is then removed from the water inlet opening 31 and water is poured into the interior of the middle portion 12 to a middle portion full water level MPFWL. This occurs with the water release valve 35 in a sealed, closed position to prevent water from escaping through the water outlet 34. The cap 32 is then re-positioned to the water inlet opening 31 and the middle portion 12 is remounted to the bottom portion 13. It should be understood that the size and resulting weight of the middle portion and water therein normally determines whether the middle portion is removed during water filling or maintained in a position on the bottom portion. The top portion 11 is then repositioned upon the middle portion 12 and the water release valve 35 is moved to its open position to allow water to flow through the water outlet 34 and into the bottom portion 13. This water is intended to reach a shallow depth or normal water level NWL within the tub through the siphon action of the water. Typically, the water is maintained at this shallow depth through the siphon action and vacuum within the middle portion 12, as is conventionally known in the art. The water within the bottom portion 13 saturates the wicks 44 so that it subsequently may be evaporated.

The blower assembly 17 is then energized through any type of conventional power, a.c. or d.c. current, and actuation of the control switches 21 and 22. With the blower assembly activated air is drawn into the humidifier through the air inlet ports 37, through the air inlet channel 48 and through the saturated wicks 44. This humidified air then travels through the central air passage 27 of the middle portion, through the central passage 14 of the top portion, and out of the top opening in the top portion.

It should be understood that should the vacuum within the middle portion 12 be accidentally disrupted, for instance as a result of not properly positioning the cap 32, thereby causing water to be uncontrollably released through the water release valve 35 and into the bottom portion 13, the water level within the middle portion will reach an equilibrium level MPEWL equal to or less than catastrophic water lever CEWL within the bottom portion, depending upon the amount of water within the middle portion. When the middle portion equilibrium water lever MPEWL reaches the same height or equilibrium level with the bottom portion catastrophic equilibrium water lever CEWL the flow of water from the middle portion to the bottom portion will cease. As this equilibrium water level is below the height of the bottom portion side walls 42 SH1 the water will be completely captured and will not overflow onto the underlying floor. The humidifier 10 can then be moved to a location where the water can be safely removed.

It should be understood that the difference in the volume of water within the middle portion between the water tank maximum water volume MPMV corresponding to the middle portion full water level MPFWL and an equilibrium water volume MPEV corresponding to the middle portion equilibrium water level MPEWL is less than the catastrophic water volume CV within the bottom portion corresponding to the maximum equilibrium water level CEWL. In other words, the middle portion is configured to contain a maximum volume of water which is divided between a first water volume therein above the middle portion equilibrium water level MPEWL and a second water volume therein below the middle portion equilibrium water level MPEWL. The first water volume being equal to or less than the bottom portion catastrophic water volume.

It thus is seen that a humidifier is now provided that includes a safety reservoir to capture water. It should be understood that many modifications may be made to the specific preferred embodiment described herein without departure from the spirit and scope of the invention as described by the following claims.

The invention claimed is:

1. A humidifier comprising:

a housing defining an air channel and a water reservoir, said water reservoir having a select water level height to contain a select maximum water volume;

a water tank having an outer wall and an inner wall spaced from said outer wall to define a water holding area adapted to contain a select maximum volume of water, said water tank being positioned at least partially within said housing reservoir and being adapted to supply water to said water reservoir, said water tank inner wall defining an interior air channel in fluid communication with said housing air channel; and a motorized fan positioned to create an airflow through said housing air channel and said interior air channel;

said water reservoir and said water tank having a maximum equilibrium water level therebetween, said maximum equilibrium water level being below said water reservoir select water level height, whereby should the water within the water tank overflow into the water reservoir the overflowing water is fully contained within the water reservoir when an equilibrium state is reached between the water reservoir and the water tank.

2. The humidifier of claim 1 wherein said water tank is annular.

3. A humidifier comprising:

a housing defining a water reservoir at least partially defining an air channel, said water reservoir being adapted to contain a select maximum water volume;

a water tank positioned at least partially within said water reservoir and being adapted to supply water to said water reservoir, said water tank configured to contain a maximum water volume, said water reservoir and said water tank having a maximum equilibrium water level therebetween, said water tank including an inner wall defining an interior air channel in fluid communication with said housing air channel, the difference in the volume of water within said water tank between said water tank maximum water volume and an equilibrium water volume corresponding to said maximum equilibrium water level being less than the fluid volume within said water reservoir corresponding to said maximum equilibrium water level less the equilibrium water volume of said water tank; and a motorized fan positioned to create an airflow through said housing;

whereby should the water within the water tank overflow into the water reservoir the overflowing water is fully contained within the water reservoir when an equilibrium state is reached between the water reservoir and the water tank.

4. The humidifier of claim 3 wherein said water tank is annular.

5. A humidifier comprising:

a housing defining a water reservoir and an air channel;

a water tank positioned at least partially within said water reservoir and having an outer wall and an inner wall spaced from said outer wall to define a water holding area between said outer wall and said inner wall, said inner wall defining an air channel extending through said water tank and in fluid communication with said housing air channel, and, a motorized fan positioned to create an airflow through said housing air channel and said water tank air channel;

said water reservoir and said water tank defining a space therebetween configured to contain a first water volume, said water reservoir and said water tank having an equilibrium water level therebetween corresponding to an equilibrium fluid state between said water reservoir and said water tank, said water tank being configured to contain a water tank maximum volume of water divided between a second water volume therein above said water tank equilibrium water level and a third water volume therein below said water tank equilibrium water level, said water tank second water volume being less than said water reservoir first water volume.

6. A humidifier comprising:

a housing defining an air channel and a water reservoir configured to contain a select maximum water volume;

a water tank adapted to be mounted to said housing and having an outer wall and an inner wall spaced from said outer wall to define a water holding area between said outer wall and said inner wall, said inner wall defining an air channel extending through said water tank and in fluid communication with said housing air channel. said water holding area being adapted to contain a maximum water volume, said water tank maximum water volume being less than water reservoir maximum water volume with said water tank mounted to said housing, and a motorized fan positioned to create an airflow through said housing air channel and said water tank air channel, whereby should the entire volume of water within the water tank be discharged into the housing the water will not overflow the housing.

7. The humidifier of claim 6 wherein said water tank is adapted to be positioned at least partially within said water reservoir.

* * * * *